US005114547A

United States Patent [19]

Ullman

[11] Patent Number: 5,114,547

[45] Date of Patent: May 19, 1992

[54] ELECTRODE

[75] Inventor: Anders Ullman, Ljungaverk, Sweden

[73] Assignee: Permascand AB, Ljungavert, Sweden

[21] Appl. No.: 551,315

[22] Filed: Jul. 12, 1990

[30] Foreign Application Priority Data

Jul. 14, 1989 [SE] Sweden ..... 8902536

[51] Int. Cl.[5] ..... C25B 9/00; C25B 11/00

[52] U.S. Cl. ..... 204/128; 204/283; 204/284; 204/252; 204/289

[58] Field of Search ..... 204/289, 288, 284, 128, 204/252, 283

[56] References Cited

U.S. PATENT DOCUMENTS

| | | | |
|---|---|---|---|
| 3,174,923 | 3/1965 | Golden et al. | 204/284 |
| 3,361,656 | 1/1968 | Miller | 204/101 |
| 3,647,672 | 3/1972 | Mehandjiev | 204/284 |
| 3,855,104 | 12/1974 | Messner | 204/278 |
| 3,901,731 | 8/1975 | Warszawski et al. | 204/240 |
| 4,059,215 | 11/1977 | Meyer | 228/179 |
| 4,263,107 | 4/1981 | Pellegri | 204/284 |
| 4,511,440 | 4/1985 | Saprokhin et al. | 204/284 |
| 4,613,414 | 9/1986 | Silvilotti et la. | 204/284 |
| 4,699,704 | 10/1987 | Ishizuka | 204/289 |
| 4,776,941 | 10/1988 | Tezanos | 204/284 |

FOREIGN PATENT DOCUMENTS

| | | | |
|---|---|---|---|
| 498467 | 12/1953 | Canada | 204/283 |
| 0159138 | 10/1985 | European Pat. Off. . | |
| 0229473 | 7/1986 | European Pat. Off. . | |
| 144383 | 3/1954 | Sweden . | |
| 1324427 | 7/1973 | United Kingdom . | |

*Primary Examiner*—John Niebling
*Assistant Examiner*—Arun S. Phasge
*Attorney, Agent, or Firm*—Burns, Doane, Swecker & Mathis

[57] ABSTRACT

An electrode for electrolysis comprisng an electrically conducting metal, the surface of which is embossed with at least one central, vertical circulation channel (2) and upwardly directed channels (1) in a herring-bone pattern, the upwardly directed channels (1) forming an angle of $<90^{\circ}$ with a horizontal line in the plane of the electrode surface and communicating with the centrally positioned, vertically directed circulation channel (2). The circulation channel (2) may be provided with penetrating slits or holes (3). The electrode may be used for electrolysis in a membrane cell, for electrochemical recovery of metals, or for recovery of chlorine from sea-water. The electrode can be manufactured by embossing the surface through stamping with a die or through rolling with a figure roller.

19 Claims, 3 Drawing Sheets

Fig. 1
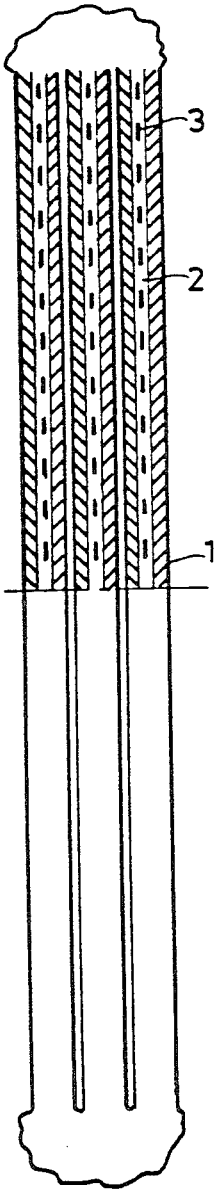
Fig. 2
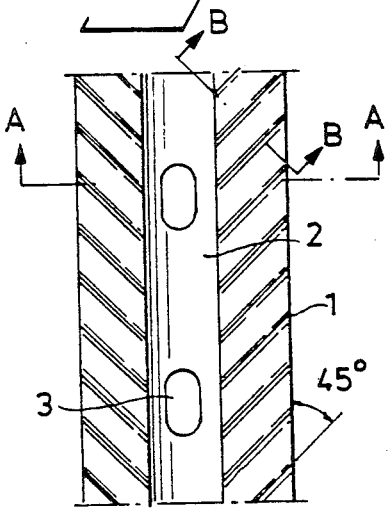
Fig. 3
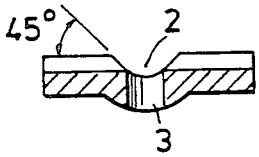
Fig. 4
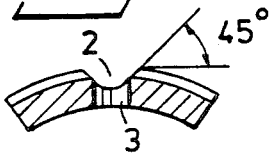
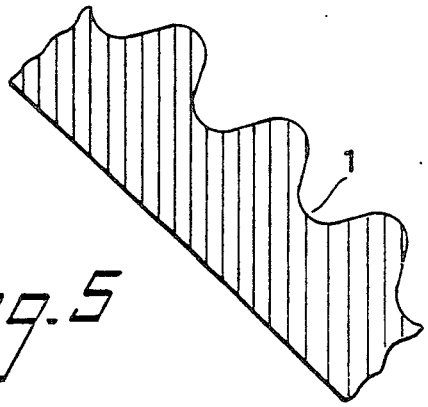
Fig. 5

Fig. 6
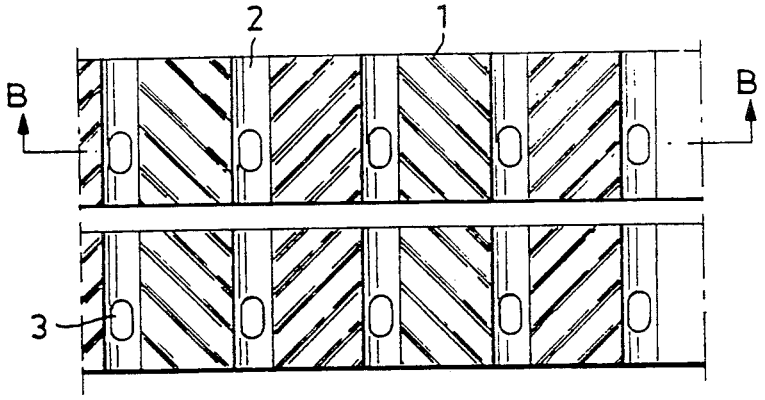
Fig. 7
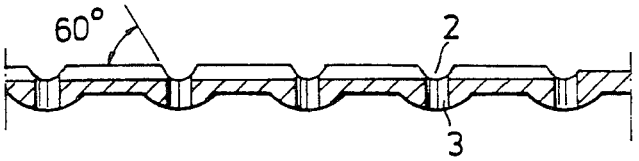
Fig. 9
Fig. 8
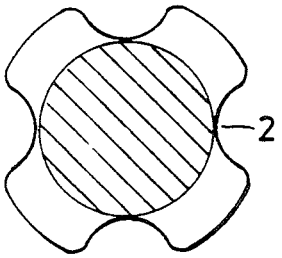
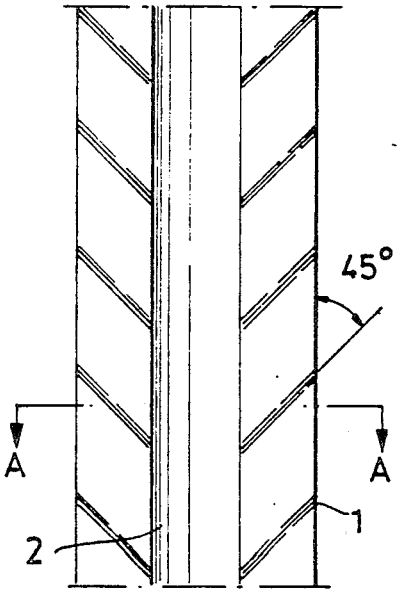

ELECTRODE

The present invention relates to an improved electrode to be used in electrolysis, more precisely an electrode with a surface configuration resulting in a more efficient removal of gaseous products and an increased circulation of electrolyte. Furthermore, the invention concerns a method for producing the electrode and uses thereof. Primarily, the electrode is intended for electrolysis in membrane cells, but it is also advantageous in other types of processes.

In electrolysis according to the membrane process, the anode chamber and cathode chamber of the electrolytic cell are separated by an ion-selective membrane. Electrolysis in membrane cells is being used within a number of areas. The major industrial application is for commercial production of chlorine.

In chlorine production, an aqueous solution of alkali metal chloride, primarily sodium chloride, is electrolysed. A brine containing about 20–25% by weight of sodium chloride is supplied to the anode chamber of the cell. In order to avoid plugging of the ion-selective membrane, the brine must have been subject to extensive purification comprising, inter alia, ion exchange, before being supplied to the cell. In the electrolysis, chlorine gas forms at the anode surface, and the gas evolved is directed out of the cell through a special outlet for the gas on top of the cell. The brine is depleted of about 5 to 10% by weight before being recycled after the addition of fresh sodium chloride.

Water or diluted sodium hydroxide is supplied to the cathode chamber. Alkali metal ions are conducted from the anode chamber, through the ion-selective membrane, to the cathode chamber which will contain a sodium hydroxide solution with a content of about 20–35% by weight with respect to sodium hydroxide. The hydrogen gas formed in the electrolysis and the concentrated sodium hydroxide are conducted out of the cell for further cleaning.

Since the cost for electric power is the predominant expenditure in the electrolytic process, considerable efforts have been made to reduce the energy consumption. Thus, highly developed catalysts are used on both the anode and cathode surfaces. Furthermore, use is made of thin membranes, a specific electrode geometry and high temperature.

To reduce the resistance of the solution which is to be electrolysed, it is desirable to make the gap between the anode and cathode as small as possible. It is also customary to have a slight excess pressure in the cathode chamber since sodium hydroxide is a much better conductor of electric current than is sodium chloride. Owing to this excess pressure, the thin membrane is pressed against the anode surface. When gases develop in the electrolysis, e.g. in electrolysis of alkali metal chloride, the gas bubbles tend to collect at the interface between the anode and/or cathode and the membrane, resulting in an increased resistance of the electrolyte. Several methods have been suggested to facilitate the separation of the formed gas bubbles. For example, the membrane surface has been made hydrophobic in order to minimize the size of the gas bubbles, and simultaneously avoiding adhesion to the membrane. Furthermore, it is also known to provide the electrode surface with a longitudinal pattern. For instance, EP 159,138 discloses an electrode with a design adapted to provide a rapid removal of the formed gas. This electrode comprises lamellae, but there is no embossing of the electrode surface.

Another known problem in the production of chlorine in membrane cells is the migration of sodium hydroxide through the ion-selective membrane. The alkaline film hereby formed nearest to the anode very unfavourably affects the anode catalyst, as well as the supporting anode structure.

It is known from chlor-alkali electrolysis according to the mercury process that rather moderate circulation-promoting measures result in considerable savings of energy. By optimizing the electrode geometry and applying thin guide rails of titanium, an extensive circulation of brine is obtained in the electrode gap with the aid of the formed chlorine gas bubbles. In chlorate and water electrolysis, the electrolytic cell and electrodes are formed in such a manner that the buoyancy of the chlorine gas bubbles is utilized to bring about a circulation of the electrolyte which is favourable to the process.

The present invention as stated in the claims relates to an electrode with improved electrode geometry which results in rapid removal of the formed gases and improved circulation of the electrolyte, a secondary effect being the considerable enlargement of the electrode surface. Furthermore, the invention concerns a method for producing the electrode and uses thereof. Primarily, the electrode is used for electrolysis in membrane cells, where the removal of the formed gases and the circulation of the electrolyte in the interface between membrane and anode are especially improved, but it is also advantageous in other types of electrolytical processes. Electrochemical recovery of metals and electrolytic recovery of gases from diluted solutions, such as chlorine recovery from sea-water, are examples of applications where the improved electrode geometry results in an increased effect.

The electrode comprises an electrically conducting metal, the surface of which has been embossed with centrally positioned circulation channels and upwardly directed channels arranged in a herring-bone pattern. The upwardly directed channels communicate with the centrally positioned circulation channels which, if need be, may be provided with slits or holes. Due to this construction of the electrode, a circulation of electrolyte hitherto unequalled in membrane processes is obtained in the gap between the membrane and electrode surface, which gap is so critical for the process. Besides a rapid supply of electrolyte, an efficient removal of the formed gases is also obtained. Furthermore, the alkaline film formed due to the migration of sodium hydroxide is diluted owing to the rapid flow of electrolyte.

The embossing of the electrode surface, provides the metal surface with a micro structure. The micro structure relates to the spacing of the embossed channels and the size of the channels, being such that the thin membranes used in membrane processes do not curve in to the extent that the flow of gas is prevented. The micro structure obtained by embossing the pattern, means a larger electrode surface resulting in a reduced electrode potential. In addition to improved performance, a more lenient operation of the electrode is also obtained resulting in a longer service life.

The proposed embossing results in an enlargement of the surface in the order of 2–3 times which reduces the electrode potential to a varying extent, depending on the nature of the process and the electrode reaction at issue. The enlarged surface has a favourable influence on the selectivity of the desired electrode reaction in gas-forming electrode reactions, which means that the type of gas developed depends upon the electrode geometry. For example, the development of chlorine from a weak chloride solution containing other anions is favoured in preference to the development of other gas types. This effect is intensified in more dilute solutions than the ones normally used in commercial production of chlorine and chlorate. Thus, the enlarged surface contributes to the reduction of the secondary reactions at the anode.

The herring-bone pattern consists of upwardly directed channels emanating from a central circulation channel. The upwardly directed channels form an angle with a horizontal line in the plane of the electrode surface. The channels should, however, not be vertically directed, but the angle to the horizontal line must be smaller than 90°. A suitable range for the angle is between 10°-70°, preferably between 30°-60°. The cross-section of these upwardly directed channels may be triangular or U-shaped. The size and the closeness of the channels forming the herring-bone pattern are not critical but can be chosen by the man skilled in the art. This is provided the size and spacing of the pattern on the electrode surface, still constitutes a micro structure. For example, the depth/width of the channels can be chosen between 0.3-1.0 mm, and the spacing of said channels may be 0.2-2 mm. Through the oblique, upwardly directed and narrow channels there is an accumulation of the formed gas, which ascends and is replaced by unreacted brine.

The central circulation channel is directed vertically upwards. The central circulation channel may be provided with a number of slits or holes, depending on the field of application of the electrode, through which the channel communicates with a freely circulating electrolyte on the rear side of the electrode. The number of holes or slits, their size and form may be chosen within wide limits, for example 20-60% of the length of the channel may consist of slits. Neither is the size of the circulation channel critical and may easily be chosen by the man skilled in the art with regard to the design and field of application of the electrode. Suitably, the depth/width may be 0.2-0.8 mm. The spacing of the central circulation channels may be 5-15 mm.

The herring-bone pattern according to the invention may be embossed when the electrodes are manufactured, or it may be embossed on existing electrodes, thus increasing their performance. The pattern may be embossed on electrodes of different design and with different fields of application.

An electrode frequently used in membrane cells consists of thin, curved and vertical lamellae that have been stamped out of the same sheet of metal of, for example, titanium. The lamellae are provided with the herring-bone pattern and circulation channels which are provided with slits or holes.

Another electrode often used in membrane cells is a venetian blind-type electrode which consists of a so-called gilled sheet of metal of, for example, titanium. The sheet of metal has stamped, horizontal and parallel electrode lamellae also known as gills. Upon these the herring-bone pattern according to the invention is embossed, resulting in an improved effect. Since the electrode lamellae are horizontal and the circulation channels of the pattern are vertically arranged, a number of "herring-bone patterns" will be arranged side by side on each lamella. Preferably, the entire lamella is covered with the pattern. Each "herring-bone pattern" will be delimited from an adjacent pattern by a central circulation channel in such a way that the upwardly directed channels emanate from and end in a central circulation channel. Since the electrode is used in a membrane cell, the circulation channel is provided with holes or slits.

However, when the pattern is applied to a perforated plate electrode or an electrode of expanded metal to be used in a membrane cell, the central circulation channel need not be provided with holes or slits, since the electrolyte can flow through the holes of the plate. Also on plate-shaped electrodes, a number of patterns will be applied side by side in the manner stated above.

In other electrolytical methods, e.g. the recovery of chlorine from salt water or recovery of metals by electrolysis, the pattern is applied to the electrode without holes or slits in the circulation channel, since the holes serve no useful purpose in such methods. An electrode commonly used in these methods has a number of parallel rod electrodes assembled to a larger unit. Each rod is provided with the herring-bone pattern all around.

The embossing of the pattern according to the invention may be carried out in several ways. It may, for example, be obtained by stamping with a die. It is also possible to emboss the pattern by rolling in a figure roller. When the pattern is embossed on existing electrodes, these could suitably be pickled and blasted before the embossing operation. Electrodes having an active catalyst Coating should be provided with a fresh coating after the embossing.

The slits or holes in the circulation channels may be made by conventional cutting and/or laser. The making of holes by mechanical or photochemical methods are other possibilities.

The electrode is made of an electrically conducting metal or metal alloy. The choice of metal or metal alloy depends on whether the electrode is to be used as an anode or cathode, and it is also related to the nature of the electrolyte. When, for example, a sodium chloride solution is to be electrolysed, and the electrode is to be used as an anode, the electrode is suitably made of titanium or of other valve metals, such as niobium, tantalum, tungsten, or zirconium, or alloys based on these metals. Titanium or titanium alloys are preferred as anode material.

It is common practice that the anode is provided with a coating of a catalytically active material which may consist of one or more of the metals from the platinum group, or alloys of these metals. Iridium and ruthenium are especially suitable.

When the electrode is to be used as a cathode, and the electrolyte is a sodium chloride solution, the electrode may consist of nickel, iron or another alkali-proof metal. The cathode also usually has a catalytically active coating.

Depending on the design of the cell, the arrangement of the electrode may be monopolar or bipolar.

The electrolytic cell contains a great number of anodes and cathodes, the number depending on the desired capacity. When the cell is a membrane cell, it is preferably of the filter press type.

The invention will now be described by means of the following drawings, which illustrate preferred embodiments.

FIGS. 1-5 show the herring-bone pattern embossed on an electrode consisting of stamped, flat or convex lamellae.

FIGS. 6–7 show the herring-bone pattern embossed on venetian blind-type electrodes in which the venetian blinds are horizontally arranged.

FIGS. 8–9 show the herring-bone pattern embossed on a rod-shaped electrode member of a lattice-like electrode.

FIG. 1 is a front view showing a detail of an electrode consisting of vertical lamellae stamped out of a sheet of metal. The lamellae may either be flat or convex, and each lamella has been provided with upwardly directed channels (1) and a central circulation channel (2). The circulation channel (2) has holes or slits (3). The channels (1) and (2) form the herring-bone pattern. FIG. 2 shows an enlarged view of the embossed pattern in FIG. 1. FIG. 3 shows a cross-section along the line A—A in FIG. 2 of a flat lamella, and FIG. 4 shows the same cross-section when the lamella is convex. FIG. 5 shows a cross-section along the line B—B in FIG. 2, from which the outline of the upwardly directed channels can be seen. In all Figures, the designations (1), (2) and (3) concern upwardly directed channels, central circulation channel, and holes or slits in this, respectively.

FIG. 6 is a front view showing a detail of a venetian blind-type electrode. The venetian blinds or gills are horizontally arranged and stamped out of a sheet of metal. Each venetian blind is slanted, as is apparent from FIG. 7 which is a cross-section along the line B—B, in FIG. 6. When the venetian blinds are horizontal and the embossed pattern is vertically arranged, a number of herring-bone patterns with associated circulation channels will be applied side by side, as can be clearly seen from FIG. 6.

FIGS. 8 and 9 show a rod-shaped electrode member which all around has been provided with a central circulation channel (2) and upwardly directed channels (1). FIG. 9 is a front view showing a detail of the electrode member, and FIG. 8 is a cross-section along the line A—A in FIG. 9.

Figure 10:
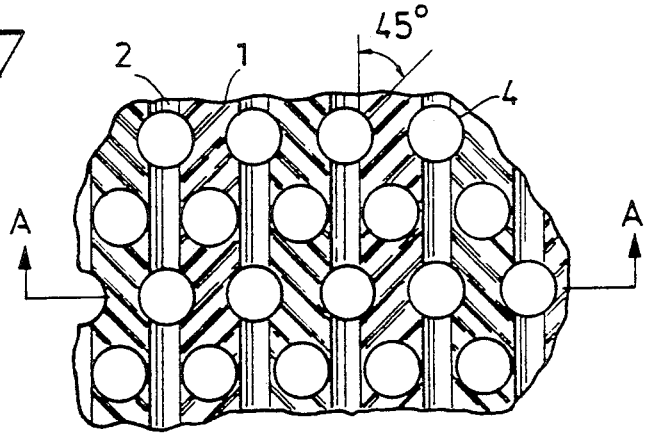
FIGS. 10–13 show the herring-bone pattern embossed on a perforated electrode and an electrode made of expanded metal.
Figure 11:
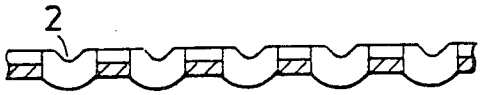
Figure 12:
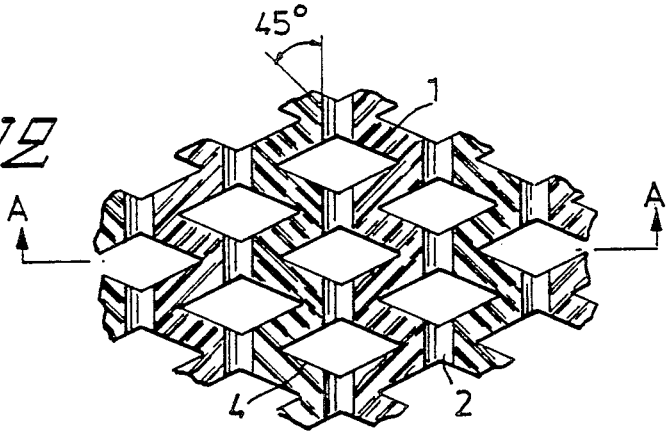
Figure 13:
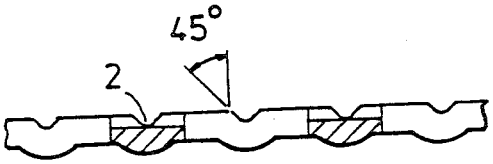

FIG. 10 is a front view showing a detail of a perforated sheet of metal on which a number of upwardly directed channels (1) with central circulation channels (2) have been applied. The holes in the perforated plate are designated (4). FIG. 11 is a cross-section along the line A—A in FIG. 10. FIG. 12 is a front view showing a detail of an expanded metal embossed with the pattern according to the invention, and finally, FIG. 13 is a cross-section along the line A—A in FIG. 12. The designations (1) and (2) have the same meaning as in the other Figures, and designation (4) refers to the holes in the expanded metal.

Although the preferred embodiments have "herring-bone patterns" with symmetrical, upwardly directed channels, the invention is not restricted thereto. The upwardly directed channels may also be unsymmetrical in relation to the central circulation channel.

I claim:

1. An electrode for electrolysis, comprising an electrically conducting metal having a surface embossed with at least one central, vertical circulation channel and with upwardly directed channels in a herring-bone pattern, the upwardly directed channels forming an angle of less than about 90° with a horizontal line in the plane of the electrode surface and communicating with the circulation channel.

2. An electrode according to claim 1, wherein the circulation channel is provided with penetrating slits or holes.

3. An electrode according to claim 1, wherein the upwardly directed channels have triangular or U-shaped cross-sections.

4. An electrode according to claim 1, comprising a thin, perforated metal plate or a plate of expanded metal.

5. An electrode according to claim 1, comprising a thin metal plate having vertical or horizontal, parallel lamellae.

6. An electrode according to claim 1, comprising parallel metal rods assembled as a unit.

7. An electrode according to claim 1, wherein said herring-bone pattern comprises a microstructure of said upwardly directed channels each having a depth and width of between about 0.3 and about 1.0 mm.

8. An electrode according to claim 7, wherein said herring-bone pattern has a spacing of said upwardly directed channels of from about 0.2 to about 2 mm.

9. An electrode according to claim 1, wherein said herring-bone pattern comprises a microstructure of upwardly directed channels each having a depth, width and spacing of sufficient size to result in (1) the accumulation in said channels of gaseous electrolytic products in an electrolytic solution of said electrolysis, (2) the ascension of said gaseous products in said channels, and (3) the replacement in said channels of electrolytic solution.

10. A method for membrane electrolysis, comprising using as an electrode the electrode claimed in claim 1.

11. A method for electrochemical recovery of metals, comprising using as an electrode the electrode claimed in claim 1.

12. A method for electrochemical recovery of chlorine from sea water, comprising using as an electrode the electrode claimed in claim 1.

13. An electrode for electrolysis, comprising an electrically conducting metal having a surface embossed with at least one central, vertical circulation channel and with upwardly directed channels, the upwardly directed channels forming an angle of less than about 90° with a horizontal line in the plane of the electrode surface and communicating with the circulation channel.

14. An electrolytic cell comprising an anode, a cathode and a membrane separating said anode and cathode, wherein at least one of said anode or cathode is an electrode comprising an electrically conducting metal having a surface embossed with at least one central, vertical circulation channel and with upwardly directed channels in a herring-bone pattern, the upwardly directed channels forming an angle of less than about 90° with a horizontal line in the plane of the electrode surface and communicating with the circulation channel.

15. An electrolytic cell according to claim 14, wherein each of said anode and cathode comprises a said electrode.

16. An electrolytic cell according to claim 14, wherein said membrane is pressed against the embossed surface of a said electrode.

17. A method for electrolytic separation of materials, comprising the steps of:

forming an aqueous solution containing the materials to be separated;

electrolyzing the aqueous solution in an electrolytic cell, thereby separating the materials;

wherein the electrolytic cell comprises an anode chamber containing an anode;

a cathode chamber containing a cathode; and an ion-selective membrane separating said anode and cathode chambers;

wherein the anode and cathode each comprises an electrically conducting metal having a surface embossed with at least one central, vertical circulation channel and with upwardly directed channels forming an angle of less than about 90° with a horizontal line in the plane of the electrode surface and communicating with the circulation channel; and forming gaseous products at at least one of said anode or cathode as a result of said electrolysis, the gaseous products accumulating in said channels, ascending in said channels, and thereby causing replacement of electrolytic solution in said channels.

18. A method according to claim 17, wherein the materials to be separated include metals.

19. A method according to claim 17, wherein the materials to be separated include chlorine from sea water.

* * * * *